US011355878B2

(12) United States Patent
Kitajima

(10) Patent No.: US 11,355,878 B2
(45) Date of Patent: Jun. 7, 2022

(54) CONNECTOR

(71) Applicant: SUMITOMO WIRING SYSTEMS, LTD., Mie (JP)

(72) Inventor: Mitsunori Kitajima, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/015,231

(22) Filed: Sep. 9, 2020

(65) Prior Publication Data

US 2021/0091494 A1 Mar. 25, 2021

(30) Foreign Application Priority Data

Sep. 19, 2019 (JP) ..... JP2019-170131

(51) Int. Cl.
*H01R 12/70* (2011.01)
*H01R 12/75* (2011.01)
*H01R 13/50* (2006.01)

(52) U.S. Cl.
CPC ..... *H01R 12/75* (2013.01); *H01R 13/50* (2013.01)

(58) Field of Classification Search
CPC ..... H01R 12/75; H01R 13/50; H01R 12/716; H01R 12/7052; H01R 12/707; H01R 12/51; H01R 13/73
USPC ..... 439/626
See application file for complete search history.

(56) References Cited

U.S. PATENT DOCUMENTS 7,001,212 B1 * 2/2006 Juntwait ..... H05K 3/301 439/566
7,094,100 B2 * 8/2006 Nakano ..... H01R 12/707 439/566
9,788,448 B2 * 10/2017 Sakai ..... H01R 13/73
2005/0227534 A1 * 10/2005 Nakano ..... H01R 12/707 439/566
2006/0264097 A1 * 11/2006 Nakano ..... H01R 12/707 439/570
2012/0122347 A1 * 5/2012 Aihara ..... H01R 12/707 439/660
2012/0264323 A1 * 10/2012 Aihara ..... H01R 12/707 439/345
2015/0270641 A1 * 9/2015 Omodachi ..... H01R 13/629 439/374
2017/0127545 A1 * 5/2017 Sakai ..... H01R 12/7011
(Continued)

FOREIGN PATENT DOCUMENTS

JP 2005-285654 A 10/2005
JP 2006-048971 A 2/2006
(Continued)

*Primary Examiner* — Abdullah A Riyami
*Assistant Examiner* — Nelson R. Burgos-Guntin
(74) *Attorney, Agent, or Firm* — Abelman, Frayne & Schwab

(57) ABSTRACT

A connector is provided with a housing 10 and plate-like fixing members 50 to be mounted on the housing 10. The housing 10 includes a plurality of insertion receiving portions 23, 24 and resin portions 36 located between the plurality of insertion receiving portions 23, 24. The fixing member 50 includes a board fixing portion 52 to be fixed on a circuit board 100 and a plurality of inserting portions 62, 63 to be respectively inserted into the plurality of insertion receiving portions 23, 24. The plurality of inserting portions 62, 63 include contact parts CP1, CP2 to be brought into contact with the resin portions 36.

6 Claims, 7 Drawing Sheets

(56) References Cited

U.S. PATENT DOCUMENTS

| | | | | |
|---|---|---|---|---|
| 2018/0048083 | A1* | 2/2018 | Doi | H01R 13/502 |
| 2020/0044374 | A1* | 2/2020 | Ishida | H01R 12/716 |
| 2020/0244011 | A1* | 7/2020 | Kitazawa | H01R 13/6585 |
| 2021/0091494 | A1* | 3/2021 | Kitajima | H01R 12/707 |

FOREIGN PATENT DOCUMENTS

| | | | |
|---|---|---|---|
| JP | 2010-055881 | A | 3/2010 |
| JP | 2011-070895 | A | 4/2011 |
| JP | 2011-187213 | A | 9/2011 |

* cited by examiner

CONNECTOR

CROSS-REFERENCE TO RELATED APPLICATIONS

This application is based on and claims priority from Japanese Patent Application No. 2019-170131, filed on Sep. 19, 2019, with the Japan Patent Office, the disclosure of which is incorporated herein in their entireties by reference.

TECHNICAL FIELD

The present disclosure relates to a connector.

BACKGROUND

A connector described in Japanese Patent Laid-open Publication No. 2006-048971 includes a housing and reinforcing tabs (hereinafter, referred to as fixing members) in the form of metal plates to be mounted on the housing. The housing includes an opening, into which a mating socket-side connector is fit, in a front surface. The housing includes fit portions in both side surfaces. The fixing members are fit into the fit portions. The fixing member includes a fixed tab piece and a non-fixed tab piece. The fixed tab piece includes a fitting portion to be fixed to the housing and a solder joint portion to be joined to a circuit board by soldering. The fitting portion is inserted into the fit portion. The fitting portion includes a plurality of projections on both side surfaces. The plurality of projections ensure the fitting strength of the fitting portion to the fit portion. The non-fixed tab piece includes a non-fixed lead portion not fixed to the housing and a solder joint portion to be joined to the circuit board by soldering. The non-fixed lead portion is arranged away from the fit portion (see FIGS. 2, 4 of Japanese Patent Laid-open Publication No. 2006-048971). Note that connectors with fixing members of this type are also disclosed in Japanese Patent Laid-open Publication Nos. 2011-070895, 2011-187213, 2005-285654 and 2010-055881.

SUMMARY

If a fitting force of the mating socket-side connector becomes excessive, the fixing members cannot resist the fitting force and may come out from the fit portions of the housing. Further, if the housing is twisted by the mating socket-side connector, the fit portions of the housing may be broken by the fixing members.

Accordingly, it is aimed to provide a connector in which a holding force of a part of a housing for receiving a fixing member is enhanced.

The present disclosure is directed to a connector with a housing and a plate-like fixing member to be mounted on the housing, wherein the housing includes a plurality of insertion receiving portions and a resin portion located between the plurality of insertion receiving portions, the fixing member includes a board fixing portion to be fixed to a circuit board and a plurality of inserting portions to be respectively inserted into the plurality of insertion receiving portions, and each of the plurality of inserting portions includes a contact part to be brought into contact with the resin portion.

According to the present disclosure, it is possible to provide a connector in which a holding force of a part of a housing for receiving a fixing member is enhanced.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
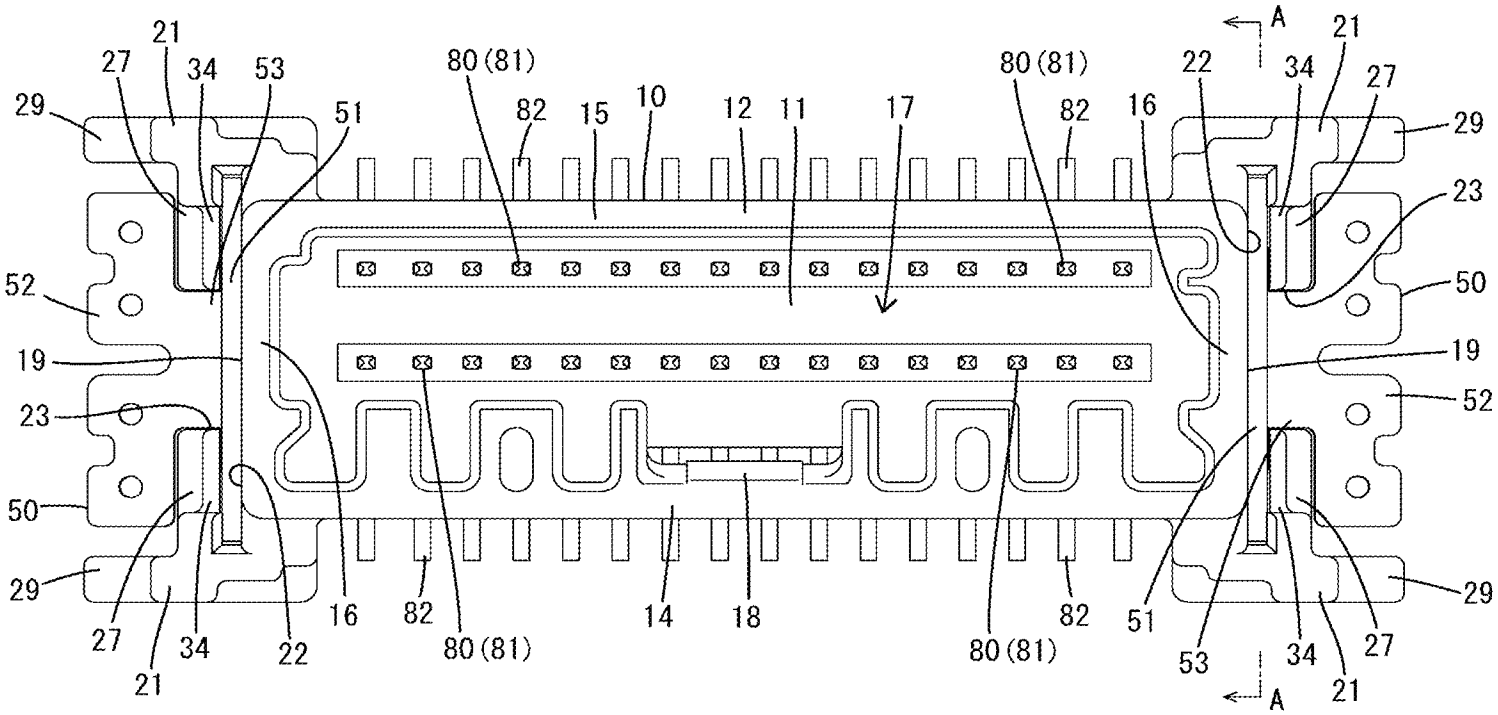
FIG. 1 is a plan view of a connector according to an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is proved with a housing and a plate-like fixing member to be mounted on the housing, wherein the housing includes a plurality of insertion receiving portions and a resin portion located between the plurality of insertion receiving portions, the fixing member includes a board fixing portion to be fixed to a circuit board and a plurality of inserting portions to be respectively inserted into the plurality of insertion receiving portions, and each of the plurality of inserting portions includes a contact part to be brought into contact with the resin portion. According to this configuration, the plurality of inserting portions are respectively inserted into the insertion receiving portions, whereby the contact parts of the respective inserting portions contact the resin portion. Thus, a state where each inserting portion is inserted in each insertion receiving portion is stably maintained. As a result, a holding force of the housing to hold the fixing member can be enhanced.

(2) The contact part preferably includes a projection projecting from a side edge of the inserting portion and configured to bite into the resin portion. According to this configuration, the state where each inserting portion is inserted in each insertion receiving portion is more reliably maintained.

(3) The housing may include a fitting portion open toward the same side as insertion openings of the plurality of insertion receiving portions, and a mating housing may be fit into the fitting portion. When the mating housing is inserted into the fitting portion, a large force acts on each inserting portion. In the case of this configuration, since the contact parts of the plurality of inserting portions are in contact with the resin portion, the state where each inserting portion is inserted in each insertion receiving portion can be satisfactorily maintained against the above force.

(4) The housing may include a covering wall for covering the plurality of insertion receiving portions from outside, and the resin portion may be coupled to the covering wall. According to this configuration, the strength of the resin portion is reinforced by the covering wall. As a result, the resin portion can be prevented from being deformed by contact pressures from the contact parts.

(5) The housing may include a covering wall for covering the plurality of insertion receiving portions from outside, the plurality of insertion receiving portions may be defined between the covering wall and an inner wall facing the covering wall from inside, and an interval between the covering wall and the inner wall may be narrowed at an insertion back side of the fixing member. According to this configuration, in the process of inserting the fixing member, contact pressures of the covering wall or the inner wall and the inserting portions can be reduced. Further, the inserting portions can be tightly held in an area with a narrow interval between the covering wall and the inner wall.

(6) The plurality of inserting portions may include a first inserting portion and second inserting portions arranged on both sides of the first inserting portion, the first inserting portion may be shaped to be connected to the board fixing portion, the second inserting portions may be shaped such that tips are free ends, the plurality of insertion receiving portions may include a first insertion receiving portion into which the first inserting portion is inserted and second insertion receiving portions into which the second inserting portions are inserted, an end part of the first insertion receiving portion on an insertion back side of the fixing member may be open and facing the circuit board, and end parts of the second inserting portions on the insertion back side of the fixing member may be closed. According to this configuration, since the first inserting portion is shaped to be connected to the board fixing portion and the tips of the second inserting portions are free ends, the fixing member can have a simple structure. Further, since the end parts of the second insertion receiving portions on the insertion back side of the fixing member are closed, the strength of the housing can be ensured.

Details of Embodiment of Present Disclosure

A specific example of the connector of the present disclosure is described below with reference to the drawings. Note that the present invention is not limited to these illustrations and is intended to be represented by claims and include all changes in the scope of claims and in the meaning and scope of equivalents.

Figure 2:
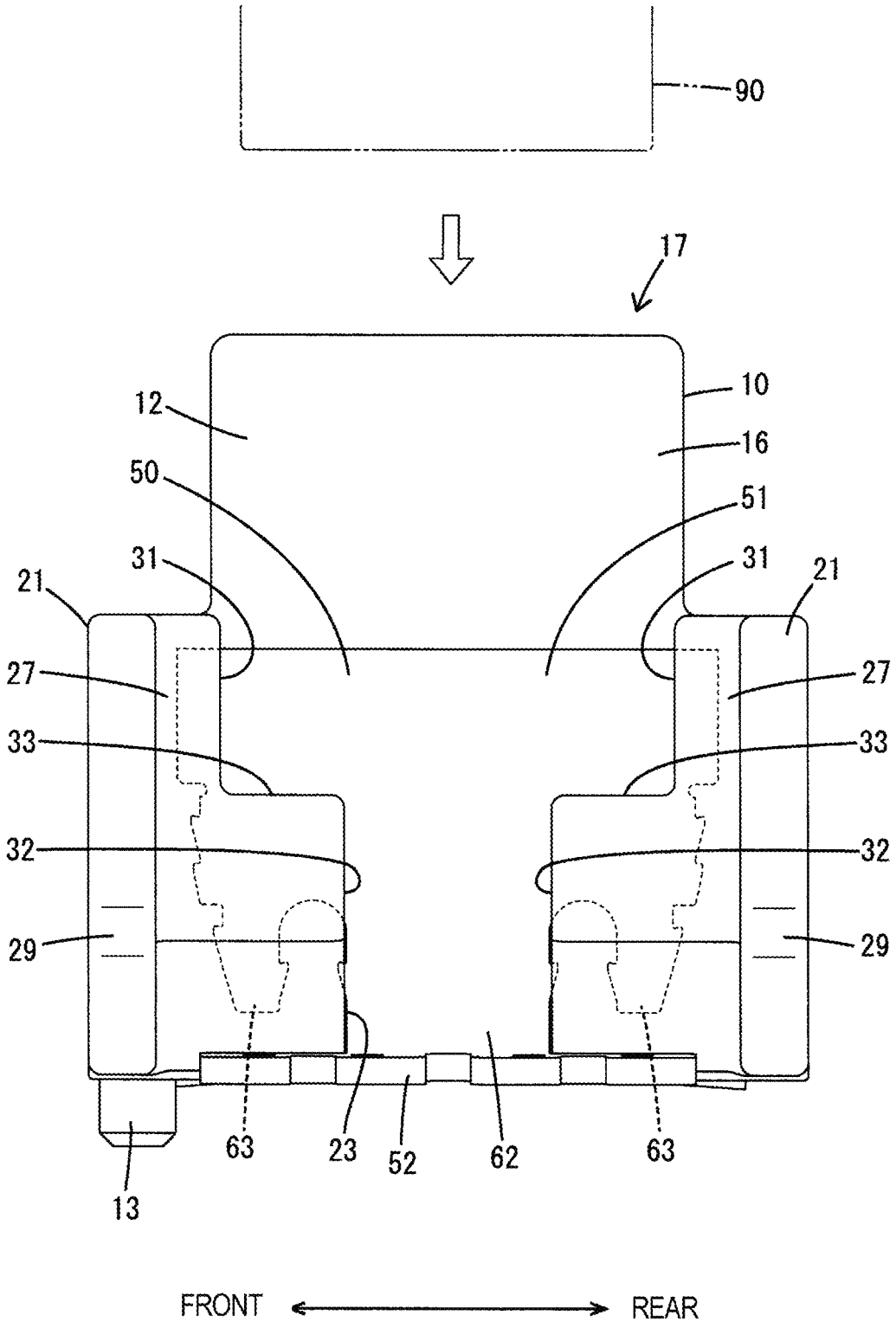
FIG. 2 is a side view of the connector.
Figure 3:
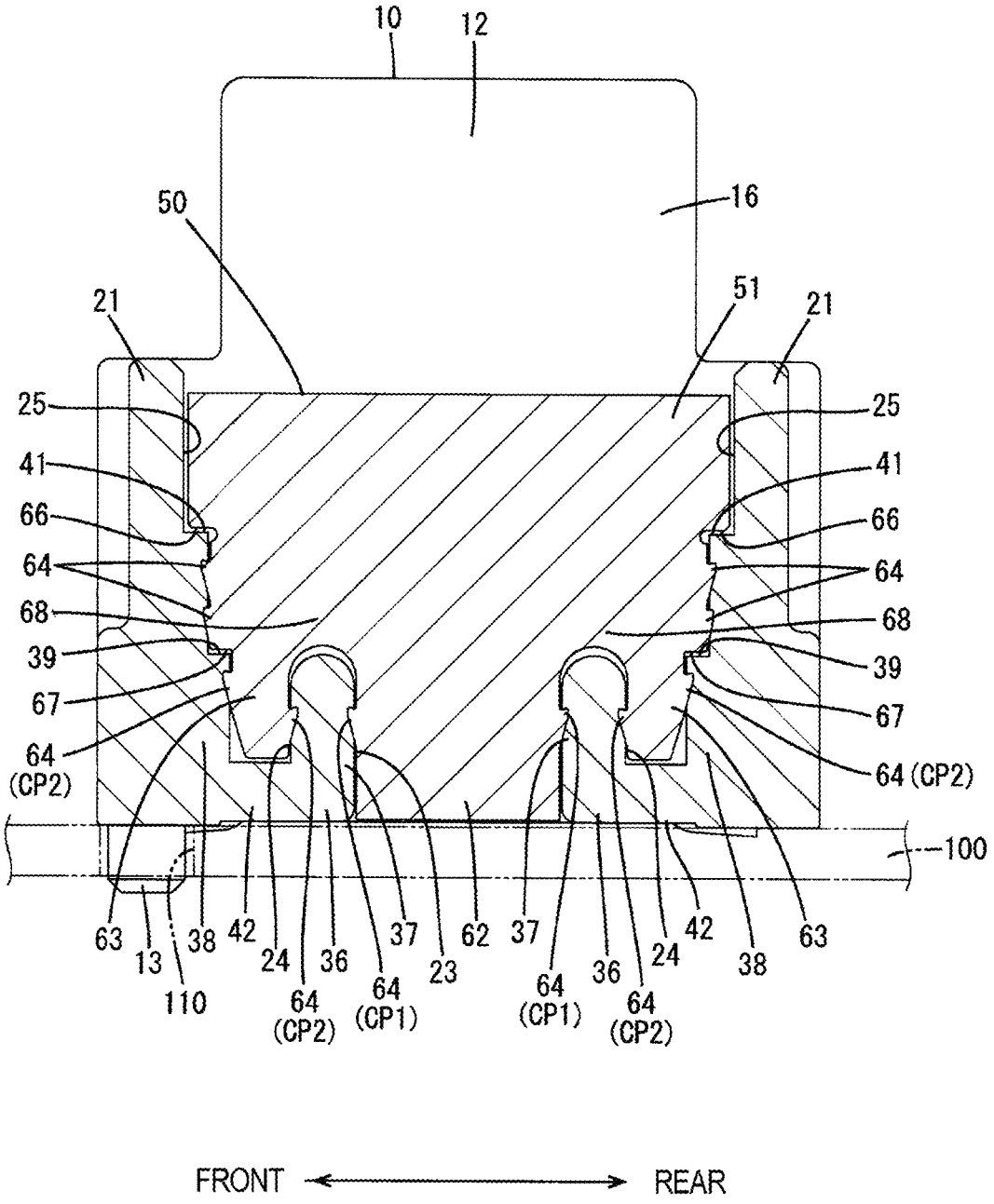
FIG. 3 is a section along A-A of FIG. 1.
Figure 4:
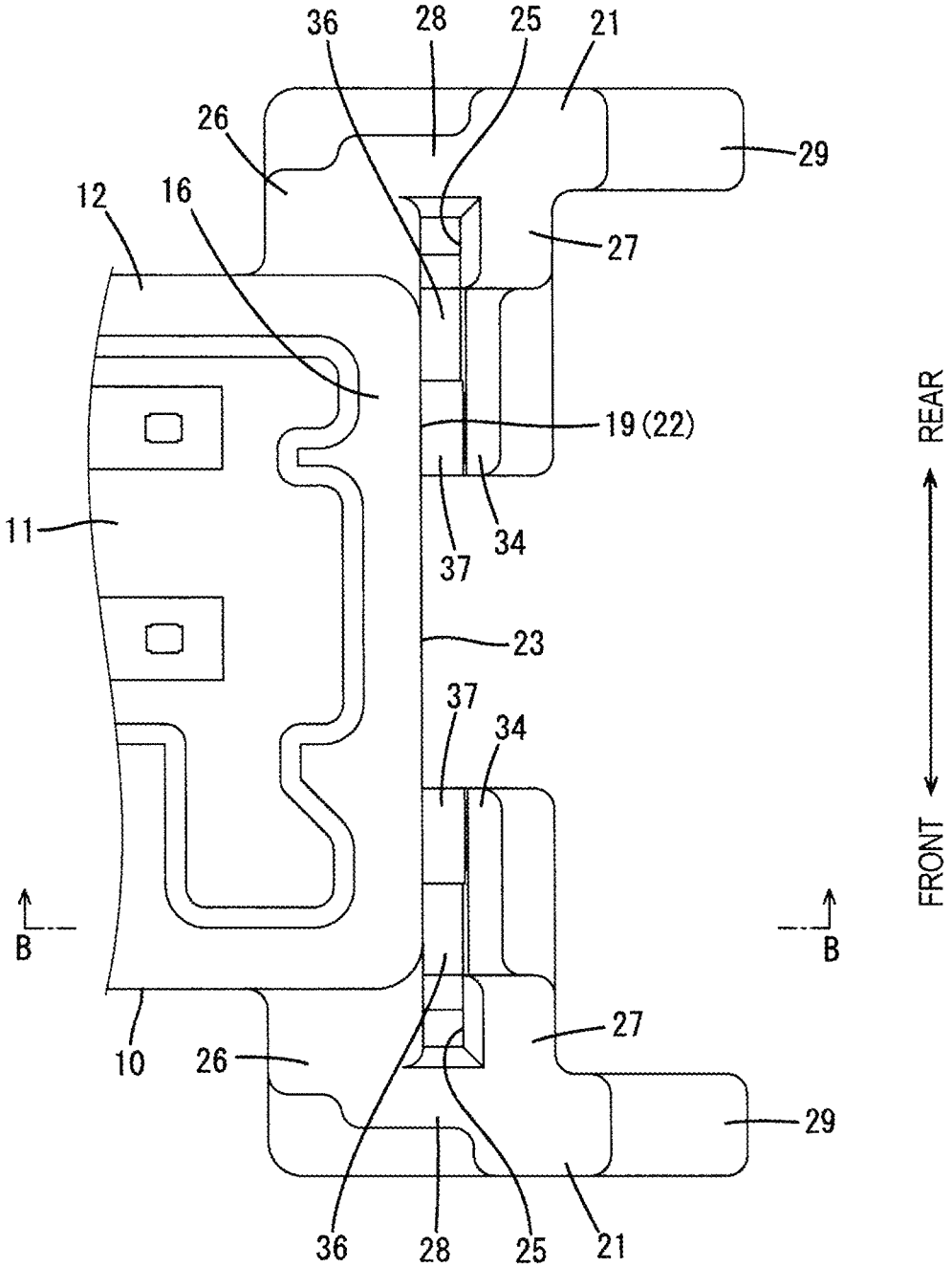
FIG. 4 is a plan view enlargedly showing an end part of a housing.
Figure 5:
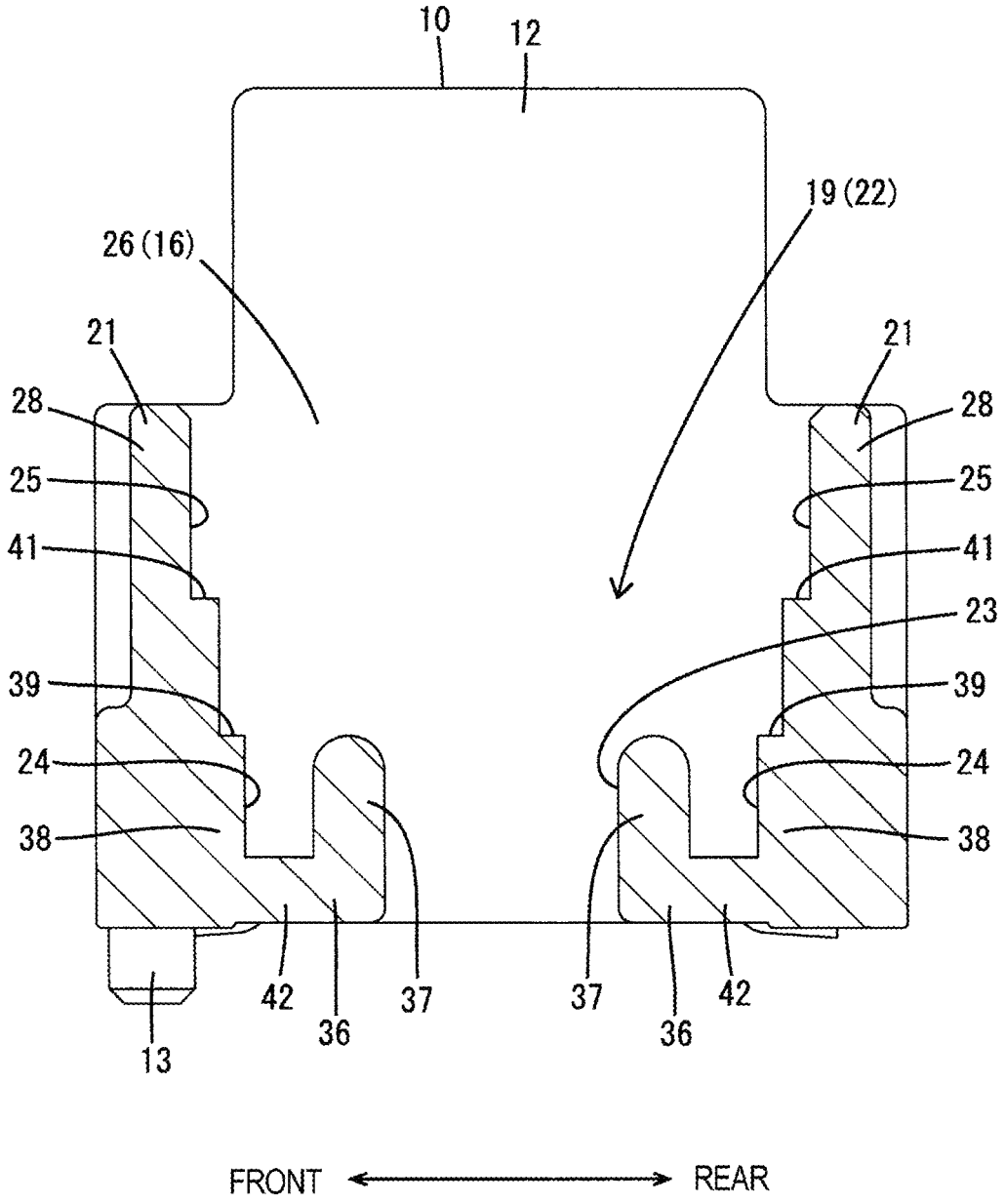
FIG. 5 is a section showing a mounting groove of the housing.

As shown in FIG. 1, the connector includes a housing 10, fixing members 50 to be mounted on the housing 10 and a plurality of terminal fittings 80 to be mounted into the housing 10. The housing 10 is a molded member made of synthetic resin. The fixing members 50 are plate members made of metal. The terminal fittings 80 are pin-like members made of metal. The housing 10 is disposed on a circuit board 100 via the fixing members 50. The housing 10 is connected to a mating housing 90 while being disposed on the circuit board 100. Note that, in the following description, a vertical direction is based on each figure except FIGS. 1 and 4. A width direction is equivalent to a lateral direction of FIGS. 1, 4 and 6. A front-rear direction is equivalent to a lateral direction of FIGS. 2, 3 and 5. A left side of FIGS. 2, 3 and 5 is referred to as a front side.

<Housing 10>

As shown in FIG. 1, the housing 10 is shaped to be long in the width direction and includes a back wall portion 11 and a receptacle 12 projecting upward from the outer peripheral edge of the back wall portion 11. The back wall portion 11 is in the form of a flat plate and arranged to face the circuit board 100 (see FIG. 3) across a gap. The housing 10 includes a positioning pin 13 projecting downward on a front end part of the back wall portion 11. As shown in FIG. 3, the positioning pin 13 is inserted into a positioning hole 110 formed in the circuit board 100.

The receptacle 12 is in the form of a rectangular tube and includes, as shown in FIG. 1, a front wall 14 located on a front side, a rear wall 15 located on a rear side and a pair of side walls 16 located on both widthwise ends. The housing 10 includes a fitting portion 17 open upwardly of the back wall portion 11 in the receptacle 12. As shown in FIG. 2, the mating housing 90 is inserted into the fitting portion 17 of the housing 10 from above.

As shown in FIG. 1, the receptacle 12 includes a lock portion 18 on the inner surface (surface facing the fitting portion 17) of the front wall 14. The lock portion 18 locks the mating housing 90 and holds the both housings 10, 90 in a connected state. The plurality of terminal fittings 80 are mounted through the back wall portion 11.

As shown in FIG. 1, the housing 10 includes a pair of receiving portions 19 for receiving the fixing members 50 in both widthwise end parts. Each of the both receiving portions 19 includes a pair of front and rear protruding portions 21. The front protruding portion 21 projects forward of the front wall 14 and laterally of the side wall 16. The rear protruding portion 21 projects rearwardly of the rear wall 15 and laterally of the side wall 16. As shown in FIG. 2, the protruding portions 21 are lower in height than the receptacle 12.

The pair of receiving portions 19 include mounting grooves 22. As shown in FIG. 5, the mounting groove 22 includes a plurality of insertion receiving portions 23, 24 arranged in the front-rear direction. A groove surface of the mounting groove 22 is defined by the outer surface of the side wall 16. The fixing member 50 is inserted into the mounting groove 22 from above along the outer surface of the side wall 16. As shown in FIG. 4, front and rear end parts of the mounting groove 22 include slits 25 in the front and rear protruding portions 21. An intermediate part in the front-rear direction of the mounting groove 22 includes the first insertion receiving portion 23 open laterally.

As shown in FIG. 4, each of the front and rear protruding portions 21 includes an inner wall 26 on an inner side (left side in FIG. 4) of the slit 25 and a covering wall 27 facing the inner wall 26 on an outer side (right side in FIG. 4) of the slit 25. The inner wall 26 also includes an area of the side wall 16.

As shown in FIG. 4, each of the front and rear protruding portions 21 includes an end wall 28 closing a front/rear end of the slit 25 (side end of the groove). The end wall 28 links the inner wall 26 and the covering wall 27 in a front/rear end part of the receiving portion 19.

Figure 6:
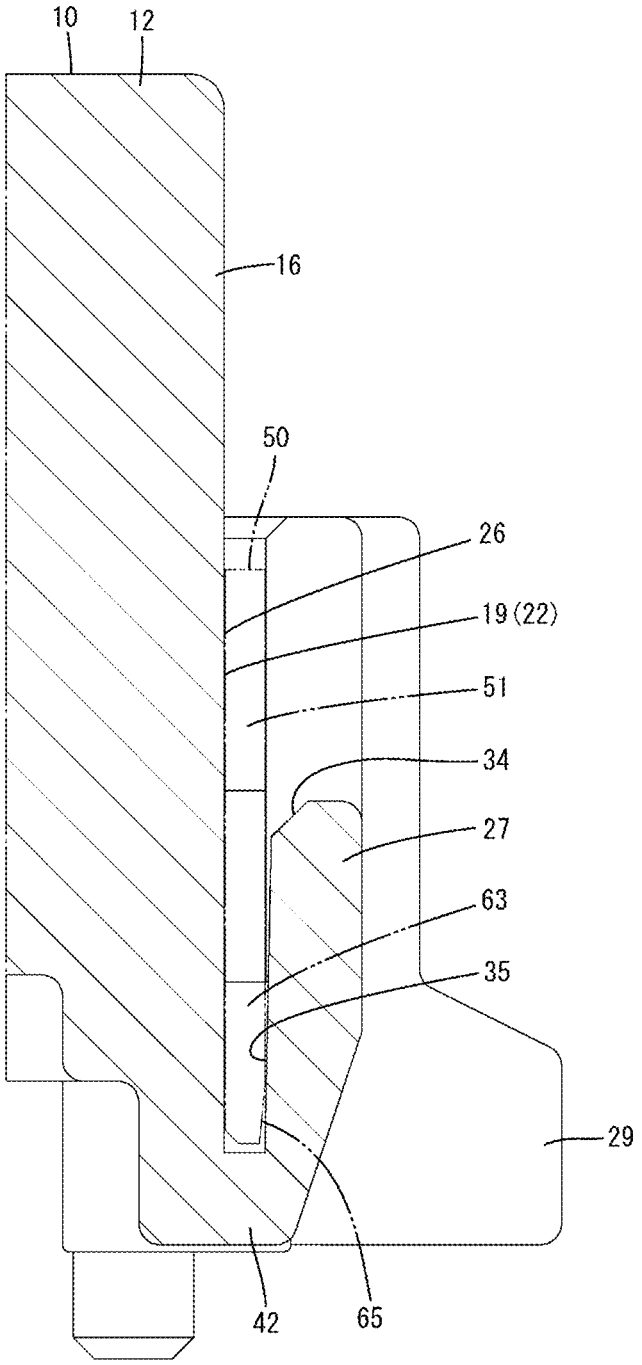
FIG. 6 is a section along B-B of FIG. 4.

The covering wall 27 includes a plate-like protection wall 29 laterally projecting from the front/rear end part. As shown in FIG. 6, the protection wall 29 is formed over the entire height of the receiving portion 19. As shown in FIG. 1, the fixing member 50 is laterally protected by the protection wall 29 while being inserted in the mounting groove 22.

As shown in FIG. 2, the covering wall 27 includes a tall wall part near a front/rear end part and a short wall part near a center in the front-rear direction. The tall wall part of the covering wall 27 includes an upper inner side edge 31 along the vertical direction. The short wall part of the covering wall 27 includes a lower inner side edge 32 along the vertical direction and an intermediate upper edge 33 along the front-rear direction. The intermediate upper edge 33 intersects with and is connected to the upper inner side edge 31 and the lower inner side edge 32. The lower inner side edge 32 of the covering wall 27 defines the first insertion receiving portion 23.

As shown in FIG. 6, the covering wall 27 has a guide surface 34 inclined downward on the upper surface of the short wall part. The covering wall 27 has a slope 35 on a lower end part (end part on an insertion back side of the fixing member 50) of the inner surface facing the slit 25 in the short wall part. The slope 35 is inclined to approach the inner wall 26 toward a lower side. Thus, a lower side of the slit 25 has a narrower dimension in the width direction (groove thickness) than an upper side.

As shown in FIG. 5, each of the front and rear protruding portions 21 includes a resin portion 36 between the inner wall 26 and the covering wall 27. The resin portion 36 defines a lower part of the slit 25. As shown in FIG. 4, the resin portion 36 is connected to the inner wall 26 on a widthwise inner side and connected to the covering wall 27 on a widthwise outer side. A thickness (dimension in the width direction) of the resin portion 36 is equivalent to the groove thickness of the slit 25.

As shown in FIG. 5, the mounting groove 22 includes the first insertion receiving portion 23 in the intermediate part in the front-rear direction and a pair of the second insertion receiving portions 24 on both front and rear sides. The first insertion receiving portion 23 is open laterally as described above. Further, the first insertion receiving portion 23 penetrates in the vertical direction.

The second insertion receiving portion 24 is formed in the slit 25 of the protruding portion 21. The second insertion receiving portion 24 is located between the covering wall 27 and the inner wall 26 and laterally closed by the covering wall 27. A groove width (dimension in the front-rear direction) of the second insertion receiving portion 24 is smaller than that of the first insertion receiving portion 23.

As shown in FIG. 5, the resin portion 36 defines the second insertion receiving portion 24 and the first insertion receiving portion 23. The resin portion 36 includes an intermediate wall 37 between the second insertion receiving portion 24 and the first insertion receiving portion 23. The upper end of the intermediate wall 37 is curved into a semicircular convex shape. Front and rear side edges of the intermediate wall 37 are formed along the vertical direction.

As shown in FIG. 5, the resin portion 36 includes a lateral wall 38 on a side opposite to the intermediate wall 37 via the second insertion receiving portion 24. The lateral wall 38 is formed to be taller than the intermediate wall 37. The lateral wall 38 includes a lower step 39 along the front-rear direction in a vertically intermediate part on a side facing the second insertion receiving portion 24. The lower step 39 is arranged at the same height as the upper end of the intermediate wall 37. The upper end of the lateral wall 38 is configured as an upper step 41 along the front-rear direction. The lateral wall 38 is connected to the end wall 28 on a side opposite to a side edge.

As shown in FIG. 5, the resin portion 36 includes a closing wall 42 between the intermediate wall 37 and the lateral wall 38 and below the second insertion receiving portion 24. The closing wall 42 is connected to the intermediate wall 37 and the lateral wall 38 and defines the lower end of the second insertion receiving portion 24.

<Terminal Fittings 80>

The terminal fitting 80 includes a terminal connecting portion 81 (see FIG. 1) extending in the vertical direction. The terminal connecting portion 81 includes a part penetrating through the back wall portion 11 and projecting into the receptacle 12 (fitting portion 17). The terminal connecting portion 81 is connected to an unillustrated mating terminal fitting mounted in the mating housing 90 when the both housings 10, 90 are connected. The terminal fitting 80 includes a board connecting portion 82 bent and extending from the lower end of the terminal connecting portion 81. The board connecting portion 82 includes a part to be arranged along a surface of the circuit board 100. The board connecting portion 82 is connected to an unillustrated conductive path of the circuit board 100 by soldering.

<Fixing Members 50>

Figure 7:
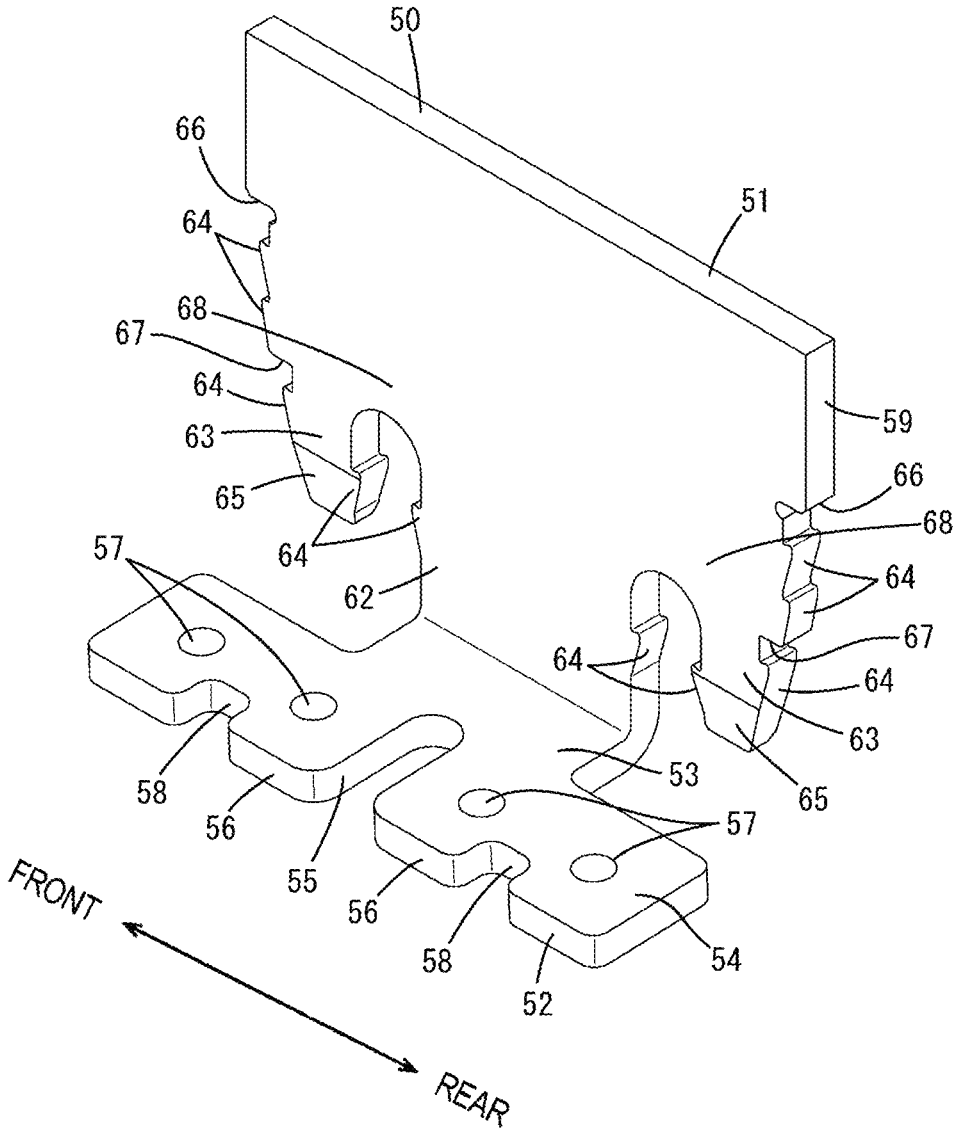
FIG. 7 is a perspective view of a fixing member.

The fixing member 50 is formed by a flat metal plate. As shown in FIG. 7, the fixing member 50 includes a housing mounting portion 51 and a board fixing portion 52. The housing mounting portion 51 is formed along the vertical direction with plate surfaces facing in the width direction. The board fixing portion 52 is formed along the width direction with plate surfaces facing in the vertical direction. The board fixing portion 52 is connected at a right angle to the lower end of the housing mounting portion 51.

As shown in FIG. 7, the board fixing portion 52 includes a base end portion 53 projecting in the width direction from the lower end of the housing mounting portion 51 and a solder connecting portion 54 protruding forward and rearward from a tip side of the base end portion 53. The solder connecting portion 54 includes a cutout 55 formed in an intermediate part in the front-rear direction and a pair of connecting pieces 56 arranged on both front and rear sides of the cutout 55. The connecting piece 56 includes a plurality of holes 57 and a recess 58 formed in a widthwise end part. The recess 58 is formed between the front and rear holes 57. The board fixing portion 52 is disposed on the surface of the circuit board 100 and fixed by soldering. Solder enters the cutout 55, each hole 57 and each recess 58. In this way, the bonding strength of the board fixing portion 52 to the circuit board 100 is enhanced.

As shown in FIG. 7, the housing mounting portion 51 includes a coupling portion 59 having a large width in the front-rear direction in an upper end part. The coupling portion 59 has a rectangular shape.

As shown in FIG. 7, the housing mounting portion 51 includes a plurality of inserting portions 62, 63 projecting downward from the coupling portion 59. The plurality of inserting portions include a first inserting portion 62 arranged in an intermediate part in the front-rear direction and a pair of second inserting portions 63 arranged on both front and rear sides. The first inserting portion 62 excluding projections 64 to be described later has the same width in the front-rear direction as the base end portion 53 of the board fixing portion 52. The lower end of the first inserting portion 62 is connected at a right angle to the base end portion 53 of the board fixing portion 52. As shown in FIG. 3, the first inserting portion 62 is inserted into the first insertion receiving portion 23.

The first inserting portion 62 includes the projections 64 on respective front and rear side edges. The projection 64 is formed into a claw having a projecting amount gradually increased toward an upper side. A maximum width in the front-rear direction of a part of the first inserting portion 62 formed with the projections 64 is larger than a width in the front-rear direction of an inner space of the first insertion receiving portion 23.

The width in the front-rear direction of the second inserting portion 63 is smaller than that of the first inserting portion 62. The lower end of the second inserting portion 63 is a free end and arranged above the board fixing portion 52. As shown in FIG. 7, the second inserting portion 63 includes a guiding portion 65 tapered such that a dimension in the front-rear direction and a width decrease toward the free end.

The second inserting portion 63 includes projections 64 on respective front and rear side edges. Each projection 64 is formed similarly to the projections 64 of the first inserting portion 62. The projections 64 on the lower end of the second inserting portion 63 are integrated with the guiding portion 65. Further, the projections 64 on the lower end of the second inserting portion 63 are arranged at the same height as the projections 64 of the first inserting portion 62 in the vertical direction. A maximum width in the front-rear direction of a part of the second inserting portion 63 formed with the projections 64 is larger than the width in the front-rear direction of the inner space of the second insertion receiving portion 24.

Out of the respective projections 64 of the second inserting portion 63, the projections 64 facing the front/rear side edge of the housing mounting portion 51 are arranged one above the other at the same height as a reinforcing portion 68 to be described later in the vertical direction. The second inserting portion 63 is connected to the coupling portion 59 via an upper step portion 66 along the front-rear direction. As shown in FIG. 3, the second inserting portion 63 includes a lower step portion 67 along the front-rear direction between the respective projections 64 arranged one above the other and the projection 64 on the lower end. The upper step portion 66 is arranged along the upper step 41 of the lateral wall 38 and the lower step portion 67 is arranged along the lower step 39 of the lateral wall 38.

As shown in FIG. 7, the housing mounting portion 51 includes a pair of front and rear reinforcing portions 68 between the second inserting portions 63 and the first inserting portion 62. The lower ends of the reinforcing portions 68 are curved into a semicircular concave shape. The lower ends of the reinforcing portions 68 are arranged along the upper ends of the intermediate walls 37.

<Assembling Structure>

The housing mounting portion 51 of the fixing member 50 is inserted into the mounting groove 22 of the housing 10 from above. In the process of inserting the fixing member 50, the base end portion 53 of the board fixing portion 52 passes through the first insertion receiving portion 23 (see FIG. 1). In this way, the interference of the board fixing portion 52 with the housing 10 is avoided. When the housing mounting portion 51 is properly inserted into the mounting groove 22, the upper step portions 66, the lower step portions 67, the lower ends of the reinforcing portions 68 and the lower ends of the second inserting portions 63 are respectively arranged to be able to contact the upper steps 41, the lower steps 39, the upper ends of the intermediate walls 37 and the upper ends of the closing walls 42 from above (see FIG. 3). In this way, the downward escape of the fixing member 50 from the receiving portion 19 is prevented.

The first inserting portion 62 is inserted into the first insertion receiving portion 23 along the vertical direction. The plate surface on the widthwise inner side of the first inserting portion 62 is arranged along the outer surface of the side wall 16. The widthwise outer side of the first inserting portion 62 is arranged to be laterally exposed via the first insertion receiving portion 23.

The second inserting portions 63 are inserted into the second insertion receiving portions 24 along the vertical direction. The plate surfaces on the widthwise inner sides of the second inserting portions 63 are arranged along the outer surface of the side wall 16. The widthwise outer sides of the second inserting portions 63 are closed by the covering walls 27 (see FIG. 2).

In an initial stage of the process of inserting the fixing member 50, the guiding portions 65 of the second inserting portions 63 are inserted into the second insertion receiving portions 24 while being guided by the guide surfaces 34. During the process of inserting the fixing member 50, the guiding portions 65 of the second inserting portions 63 are guided toward a lower side (back side in an inserting direction) along the slopes 35. During this time, contact pressures of the second inserting portions 63 and the covering walls 27 can be reduced. With the fixing member 50 properly inserted in the mounting groove 22, the guiding portions 65 of the second inserting portions 63 are located on the bottoms of the second insertion receiving portions 24 and arranged to be able to contact the closing walls 42 and the covering walls 27.

As shown in FIG. 3, the front and rear side edges of the first inserting portion 62 are arranged to be able to contact the side edges facing the first insertion receiving portion 23 (hereinafter, referred to as one side edges) on the front and rear intermediate walls 37 (see contact parts CP1). The front and rear side edges of the second inserting portions 63 are arranged to be able to contact the side edges facing the second insertion receiving portions 24 (hereinafter, referred to as other side edges) on the intermediate walls 37 and the side edges facing the second insertion receiving portions 24 on the lateral walls 38 (see contact parts CP2).

The respective front and rear projections 64 of the first inserting portion 62 constitute the contact parts CP and bite into the one side edges of the front and rear intermediate walls 37. The respective front and rear projections 64 of the second inserting portions 63 constitute the contact parts CP2 and bite into the other side edges of the intermediate walls 37 and the side edges of the lateral walls 38. In this way, the upward escape of the fixing member 50 from the mounting groove 22 is restricted.

Thereafter, the connector is placed on the circuit board 100. The board fixing portions 52 of the fixing members 50 are soldered to the circuit board 100 by a reflow process together with the board connecting portion 82 of each terminal 80. In this way, the connector is fixed to the circuit board 100 via the fixing members 50.

With the connector mounted on the circuit board 100, the mating housing 90 is inserted into the fitting portion 17 of the housing 10 from above (see FIG. 2). When the mating housing 90 is inserted into the fitting portion 17 of the housing 10, a large connection force acts on the fixing members 50 and a large stress acts also on the receiving portions 19 for receiving the housing mounting portions 51 of the fixing members 50. In that respect, the housing mounting portions 51 can contact the resin portions 36 of the receiving portions 19 at a plurality of positions in the case of this embodiment. Thus, the housing mounting portions 51 can be maintained in a state stably held in the receiving portions 19 even when receiving a large connection force.

Specifically, in the case of this embodiment, the front and rear side edges of the first inserting portion 62 are arranged to be able to contact along one side edges of the front and rear intermediate walls 37 (see contact parts CP1) as shown in FIG. 3. The front and rear side edges of the second inserting portions 63 are arranged to be able to contact along the other side edges of the front and rear intermediate walls 37 and the side edges of the lateral walls 38 (see contact parts CP2). The lower end of the first inserting portion 62 is arranged to be able to contact the closing walls 42. The upper step portions 66 of the coupling portion 59 are arranged to be able to contact the upper steps 41 of the lateral walls 38. The lower step portions 67 of the second inserting portions 63 are arranged to be able to contact the lower steps 39 of the lateral walls 38. Further, the lower ends of the reinforcing portions 68 are arranged to be able to contact the lower ends of the intermediate walls 37. Then, the respective projections 64 of the first inserting portion 62 bite into the one side edges of the front and rear intermediate walls 37. The respective projections 64 of the second inserting portions 63 bite into the other side edges of the intermediate walls 37 and the side edges of the lateral wall 38.

As just described, the first inserting portion 62, the second inserting portions 63, the reinforcing portions 68 and the coupling portion 59 are arranged to be able to contact the corresponding resin portions 36 and the respective projections 64 bite into the corresponding resin portions 36, whereby the housing mounting portion 51 can be prevented from escaping from the receiving portion 19 or being shifted in position even if the fixing member 50 receives an external force such as a connection force. Thus, according to this embodiment, reliability in holding the fixing member 50 by the housing 10 can be improved.

Particularly, the resin portions 36 are coupled to the covering walls 27 to enhance rigidity. Thus, the resin portions 36 can be prevented from being deformed due to contact with the housing mounting portion 51.

Further, lower end parts between the covering walls 27 and the inner walls 26 (end parts on the insertion back side of the fixing member 50) are narrowed via the slopes 35. Thus, in the process of inserting the fixing member 50, contact pressures of the second inserting portions 63 and the covering walls 27 can be reduced. As a result, the housing mounting portion 51 can be easily mounted. Further, the second inserting portions 63 can be tightly held in lower parts between the covering walls 27 and the inner walls 26.

Furthermore, since the first inserting portion 62 is shaped to be connected to the board fixing portion 52 and the lower ends of the second inserting portions 63 are free ends, the fixing member 50 can be have a simple structure. Further, since the end parts of the second insertion receiving portions 24 on the insertion back side of the fixing member 50 are closed, the strength of the housing 10 can be ensured.

Other Embodiments of Present Disclosure

The embodiment disclosed this time should be considered to be illustrative rather than restrictive in all aspects.

Although the plurality of inserting portions are composed of the first and second inserting portions in the case of the above embodiment, the plurality of inserting portions may include inserting portion(s) other than the first and second inserting portions as another embodiment. If the plurality of inserting portions include the inserting portion(s) other than the first and second inserting portions, the plurality of insertion receiving portions may include insertion receiving portion(s) other than the first and second insertion receiving portions.

Although the pair of second inserting portions are provided on both front and rear sides of the first inserting portion in the case of the above embodiment, only one inserting portion may be provided side by side with a first inserting portion as another embodiment. If only one inserting portion is provided side by side with the first inserting portion, only one second insertion receiving portion may be provided side by side with a first insertion receiving portion.

Although the projections are formed on the front and rear side edges of each of the first and second inserting portions in the case of the above embodiment, the front and rear side edges of the respective first and second inserting portions may include side edge(s) formed with no projection as another embodiment. Each of the first and second inserting portions may include a contact part capable of contacting the resin portion. The contact part in this case is not limited to a projection.

Although the slope is formed on the covering wall in the case of the above embodiment, a slope may be formed on an inner wall or may be formed on both the covering wall and the inner wall as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing; and a plate-like fixing member to be mounted on the housing, wherein:

the housing includes a plurality of insertion receiving portions and a resin portion located between the plurality of insertion receiving portions, the fixing member includes a board fixing portion to be fixed to a circuit board and a plurality of inserting portions to be respectively inserted into the plurality of insertion receiving portions, and each of the plurality of inserting portions includes projections projecting from respective front and rear side edges thereof and configured to bite into the resin portion.

2. The connector of claim 1, wherein the housing includes a fitting portion open toward the same side as insertion openings of the plurality of insertion receiving portions, and a mating housing is fit into the fitting portion.

3. The connector of claim 1, wherein:

the housing includes a covering wall for covering the plurality of insertion receiving portions from outside, and the resin portion is coupled to the covering wall.

4. The connector of claim 1, wherein:

the housing includes a covering wall for covering the plurality of insertion receiving portions from outside, the plurality of insertion receiving portions are defined between the covering wall and an inner wall facing the covering wall from inside, and an interval between the covering wall and the inner wall is narrowed at an insertion back side of the fixing member.

5. The connector of claim 1, wherein:

the plurality of inserting portions include a first inserting portion and second inserting portions arranged on both sides of the first inserting portion, the first inserting portion is shaped to be connected to the board fixing portion, the second inserting portions are shaped such that tips are free ends, the plurality of insertion receiving portions include a first insertion receiving portion into which the first inserting portion is inserted and second insertion receiving portions into which the second inserting portions are inserted, an end part of the first insertion receiving portion on an insertion back side of the fixing member is open and facing the circuit board, and end parts of the second inserting portions on the insertion back side of the fixing member are closed.

6. The connector of claim 1, wherein:

the plurality of inserting portions include a first inserting portion and second inserting portions arranged on both sides of the first inserting portion, the first inserting portion is shaped to be connected to the board fixing portion, the second inserting portions are shaped such that tips are free ends, and the plurality of insertion receiving portions include a first insertion receiving portion into which the first inserting portion is inserted and second insertion receiving portions into which the second inserting portions are inserted.

* * * * *